US006053848A

United States Patent [19]

Eschenbach

[11] Patent Number: 6,053,848

[45] Date of Patent: Apr. 25, 2000

[54] TREADMILL DECK SUSPENSION

[76] Inventor: Paul William Eschenbach, 143 Lakeland Ave., Moore, S.C. 29369

[21] Appl. No.: 09/139,097

[22] Filed: Aug. 24, 1998

[51] Int. Cl.[7] ..... A63B 22/02

[52] U.S. Cl. ..... 482/54; 482/51

[58] Field of Search ..... 482/51, 54

[56] References Cited

U.S. PATENT DOCUMENTS 5,441,468 8/1995 Deckers et al. ..... 482/54

5,709,632 1/1998 Socwell ..... 482/54

*Primary Examiner*—Glenn E. Richman

[57] ABSTRACT

A deck suspension system is provided to support the belt of a treadmill with improved shock absorption from foot impact. In the preferred embodiment, the deck is suspended by a pair of cables on either side of the deck which terminate in cushions. A second pair of cables couple the intermediate deck to the framework with cushion adjustment to provide a soft or stiff cushion deck. Deck deformation distributes foot impact to a variety of shock absorption cushions to reduce leg injuries from extended exercise.

29 Claims, 7 Drawing Sheets

40
23
28
25
22
24
19
21
39
46
43
15
13
45
29
34
18
20
31
33
35
37
10
12
14
6
47
44
17
8
16
34
29
18
20
45
13
15
39
21
19
46
41
27
32
30
22
24
26
23
25
45
20
18
16
8
14
12
10
6
47
17
44
34
29
13
15
46
39
21
19

TREADMILL DECK SUSPENSION

BACKGROUND OF THE INVENTION

1. Field

The present invention relates to the field of treadmills used for standup exercise. More particularly, the present invention relates to the suspension by which the treadmill belt is supported to distribute and absorb the the shock of foot impact.

2. State of the Art

The benefits of regular exercise to improve overall health, appearance and longevity are well documented in the literature. For exercise enthusiasts the search continues for safe apparatus that provides lower body exercise without foot impact shock damage to the legs and leg joints.

A treadmill is an exercise device which permits walking or running by moving a continuous belt along the length of a chassis. The belt slides over a supporting deck with speed controlled by motor with appropriate controls or load resistance, as in the case of a manual treadmill. The belt is flexible and is unable to rigidly support the weight of the user. As the user walks or runs on the belt, the belt is pressed against the underlying supporting deck to provide mechanical support for the user body weight. The belt is generally non-extensible and typically made of reinforced flexible synthetic rubber like material.

Early treadmill designs used supporting decks that were rigidly attached to a framework without a means to absorb the shock of foot impact causing various injuries such as stone bruise or shin splints because of its hard unyielding surface. More recent treadmills use some form of belt support that includes shock absorption.

Lee in U.S. Pat. No. 4,938,473 and Walstead in U.S. Pat. No. 5,330,401 use belt suspension systems that include guided moving carriers that connect to the belt with springs or cable. Hayes in EPO Pat. No. 0196877 inserts a cushion material on top of a rigid deck to support the belt. Dunham in U.S. Pat. Nos. 4,974,831 and 5,184,988 shows a rigid deck pivotally supported at the rear and supported on the front end by shock absorber loaded levers. Parikh et al. in U.S. Pat. No. 5,649,882 uses a rigid deck with multiple spring support. However, the most popular approach is a rigid deck comprised of hardwood or composite material that is supported by elastomeric cushions.

Kirk in U.S. Pat. No. 5,542,892 shows a floating rigid deck with linear foam cushion under the deck. Skowronski et al. in U.S. Pat. No. 5,382,207 used a plurality of elastomeric cushions under the rigid deck including elliptical shaped cushions. Dalebout in U.S. Pat. No. 5,279,528 provides continuous foam cushion or adjustable air bladder under the rigid deck. Deckers et al. in U.S. Pat. No. 5,441,468 uses a rigid deck rigidly attached to the frame at the rear end and having elastomeric cushions at the other end and intermediate the deck. Rodden in U.S. Pat. Nos. 5,454,772 and 5,336,144 shows aperture shaped elastomeric cushions and guides to support a rigid deck.

All of the cushion deck prior art tends to use relatively heavy rigid decks that can move substantially vertical with very limited or no horizontal movement to absorb shock. The cushions return virtually all of the shock energy vertically back to the foot of the user to encourage stone bruise or shin splints over time to a lesser degree than a deck with no cushion support. There remains a need for a deck support system that better distributes the foot shock with minimal shock return to the foot to allow extended periods of exercise without shock related injuries.

Generally, treadmill support decks are rigid and linear. However, Sockwell in U.S. Pat. No. 5,709,632 shows a curved deck having the center of curvature above the deck wherein the deck is rigidly supported with stationary cross members. Skowronski et al. in U.S. Pat. No. 5,382,207 uses a crowned deck with the center of curvature below the deck wherein the rigid deck is secured by multiple elastomeric supports. Zaitsev in U.S. Pat. No. 5,391,129 shows a curved treadmill engaging the hands of a prone user as a swimming training device. There remains a need for a semi-rigid curved deck that has a suspension system that will allow the deck to deform with foot impact, both vertically and horizontally, and quickly disperse and absorb the shock before it is returned to the foot.

SUMMARY OF THE INVENTION

The present invention provides an exercise treadmill including a frame, first and second roller assemblies rotatably mounted on the frame, and an endless belt trained about the first and second roller assemblies. The exercise treadmill also includes a deck disposed between the frame and an upper run of the belt. The deck is semi-rigid, able to conform to a predetermined curve path or remain linear, and having a frictionless upper wear surface that can be removed.

In the preferred embodiment, the deck is suspended underneath by flexible linking; in this case, a first pair of cables on either side of the deck. The term flexible linking, in the present invention, is used to include various types of linear low extensible flexible options such as cable, wire, multiple strand wire, reinforced belt, chain, elastomeric strand and other forms. The deck can be continuous or composed of individual segments, each in contact with the first cable pair. Each first cable is supported by a curved surface proximate each end of the deck and attaches to an elastomeric cushion adjustment secured to the framework. The term cushion is used broadly to include elastomeric polymers, viscous damping, springs, air or fluid pistons, etc. that can have linear on non-linear motion attenuation.

Intermediate support ribs are attached under the deck running perpendicular to the deck length. Rotatable rib pulleys are attached to the ends of each intermediate support rib. Corresponding base pulleys are attached to the framework between and below each pair of rib pulleys. A second pair of cables alternately thread each rib and base pulley and terminate at elastomeric adjustments attached to the framework at each end of the cables.

The belt is guided by the first and second end rollers and by two idlers disposed intermediate the end rollers contacting the lower belt run. The idlers are movable to adjust the upper belt run in contact with the curved deck surface. The front end first roller is driven by a motor with appropriate speed controls while the rear end second roller is equipped with a brake to assure belt tension in the under belt run and compliance with the curved deck by the upper belt run. Alternately, the rear second roller can be motor driven instead where the first roller is also driven to maintain belt curvature. Alternately, the deck can be porus to allow a pressure differential to be imposed under the deck to maintain the belt in contact with the deck.

A cable supported deck with equal intermediate loads will follow the profile of a parabolic curve according to the "Standard Handbook for Civil Engineers" by Frederick S. Merritt, McGraw-Hill, 1983, Chapter 17. Foot impact will cause the deck to deform in both the vertical and horizontal directions along the deck and initiate a vibration wave according to "Constructing a Bridge" by Eda Kranakis, MIT Press, 1997, page 149. In this embodiment, the deck deformation and subsequent vibration wave is quickly attenuated by the elastomeric shock absorption at the ends of both the first and second cable pairs. The elastomeric adjustment on the second cable pair provides for a soft or stiff cushion selection by the user. Adjustment of the first cable pair allows varying degrees of parabolic deck curvature selected by the user.

Another embodiment includes larger end rollers without the intermediate idlers of the preferred embodiment wherein one of the rollers can be adjusted to suit the belt length. The first and second rollers are coupled by a connector belt with pulleys attached to the rollers to cause the front first roller to rotate generally faster than the rear second roller maintaining tension in the lower belt run to assure compliance of the upper belt run with the curved deck. The connector belt also drives a flywheel with load resistance common to manual treadmills. Of course, the connector belt can engage a motor for speed control.

The deck ends are attached to frame cross members proximate each roller. The cross members can be rigidly or pivotally attached to the chassis. The deck is composed of segments that are interconnected with flexible connectors, such as hinges, to form a deck chain. Each segment has an easily removable frictionless material attached to the upper deck surface. Semi-rigid ribs are attached to the deck segments to reduce side/center/side deformation. Each rib has a rib pulley attached below the rib center. Corresponding base pulleys are attached to the framework between each rib pulley below the deck. A cable alternately threads each rib and base pulley and is attached to shock absorbing cylinders. As the foot impacts the deck, the deck will deform causing the cable to extend the shock absorbers. Gas or oil filled shock absorbers quickly attenuate the shock induced vibration.

Another embodiment uses a semi-rigid composite deck suspended by cable pair between the first and second belt rollers. A first cable pair is supported by a curved surface above each roller with each end attached to an elastomeric adjustment. Hanger pulleys are attached to the first cable pair disposed intermediate the curved supports. Deck pulleys are rotatably attached along each side of the deck disposed intermediate the deck ends. A second cable pair is attached to each end of the deck and alternately threads each hanger and deck pulley. The upper first cable pair assumes a predetermined parabolic shape. Foot impact causes the parabolic shape to deform temporarily while the elastomeric shock absorbers attenuate the vibration. The deck is a sandwich composed of two generally thin rigid materials bonded to an elastomeric material in the center of the deck and a frictionless upper deck surface. As the deck deforms with foot shock, the internal elastomeric material also absorbs shock. The pulleys do not need to rotate wherein the cable movement is retarded by cable friction to form drag pulleys.

Another embodiment is given without pulleys wherein the semi-rigid composite deck is suspended by hangers on each side. The hangers are attached intermediate a cable pair that is attached to the framework at each end with an elastomeric adjustment and two curved supports disposed proximate each deck end. Impact absorption and vibration. attenuation is through the elastomeric shock absorbers at each end of the cables and the composite deck elastomeric center. Elastomeric material can also be incorporated in the hangers to further absorb shock.

A further embodiment uses a generally linear or crowned deck suspended underneath by flexible linking, in this case, a pair of cables on either side of the deck with cushioned ends. The cables form a parabolic curve that supports the deck with varying height crossover supports extending upwards to the generally flat deck. The crossover supports contact the cable with curved surfaces which can be pivoted to rotate as a roller or pulley. The deck is a flexible composite with an elastomeric layer. The deck deforms with foot impact causing the curved surfaces to move relative to the cable pair suspending the deck. Cable distortion occurs to distribute impact shock. The cables terminate with cushions to absorb foot shock.

A schematic is given to show the nature of flexible linking deformation that distributes deformation throughout the deck suspension system to be attenuated by cushions within the deck system; therefore, returning very little impact shock to the user.

In all of the above embodiments, an additional mechanism can be added to raise or lower one end of the chassis as is common with modern treadmills.

The exercise treadmill of the present invention thus provides for better shock absorption and prevention of potential shock-related injury for exercisers of varying sizes and weights as an improvement over prior art treadmill designs.

BRIEF DESCRIPTION OF THE DRAWINGS

The foregoing and other objects and features of the present invention will become more fully apparent from the following description and claims, taken in conjunction with the drawings. Understanding that these drawings depict only typical embodiments of the invention and are, therefore, not to be considered limiting of its scope or combinations, the invention will be described with addition specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 7, is not intended to limit the scope of the invention, as claimed, but is merely representative of the presently preferred embodiments of the invention.

Figure 1:
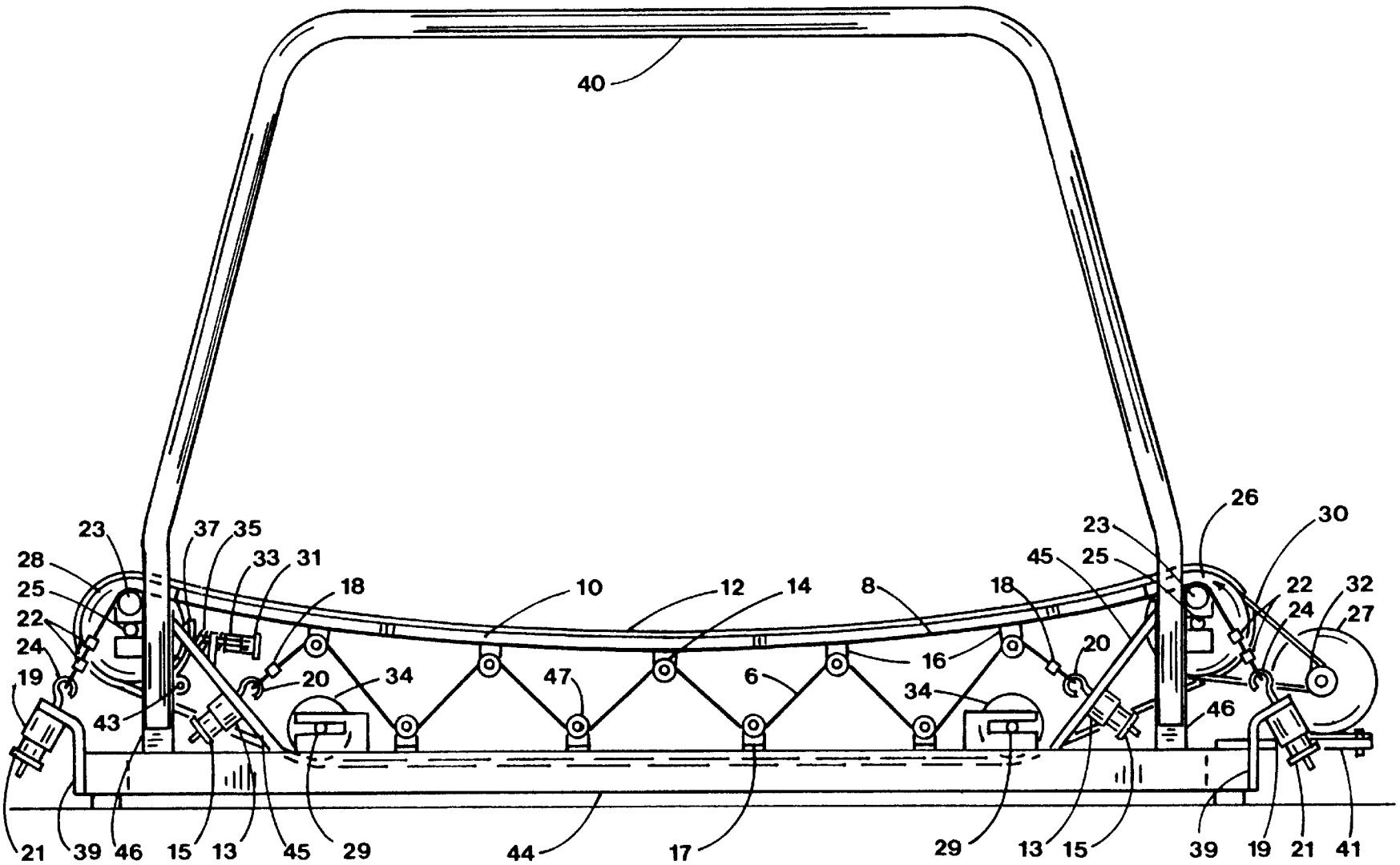
FIG. 1 is a side elevation view of the preferred embodiment of the present invention.
Figure 2:
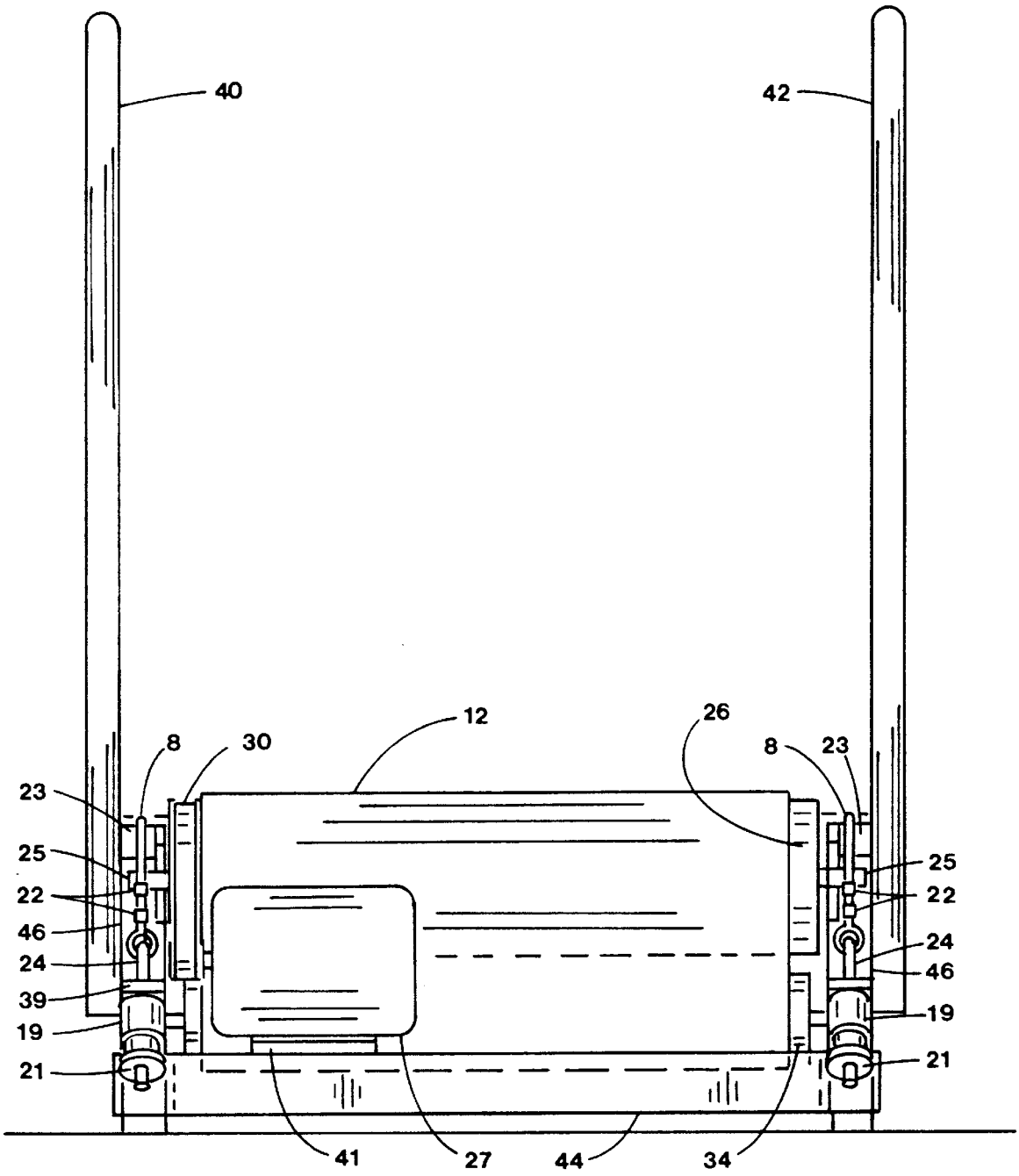
FIG. 2 is a front elevation view of the preferred embodiment shown in FIG. 1.

In the preferred embodiment shown in FIGS. 1 and 2, endless belt 12 is trained upon the front first roller 26, rear second roller 28 and pair of idlers 34. The belt 12 upper run is supported by curved deck 10 which is composed of a semi-rigid material having a removable frictionless upper surface. Deck 10 is supported by first cable pair 8 that are in slidable contact with curved support surfaces 23 and attached at the cable ends to eyebolts 24 by cable clamps 22. Eyebolts 24 pass through brackets 39, elastomeric members 19 and are threadably secured to adjustment knobs 21. Rotation of knobs 21 change the cable 8 length between the curved support surfaces 23 to vary deck 10 curvature. Idlers 34 can then be adjusted to assure belt 12 upper run compliance with the curved deck 10.

Semi-rigid ribs 16, which can bend and recover under foot weight, are attached to first cable pair 8 and positioned below deck 10 for support terminating at each side of deck 10. A set of deck pulleys 14 are attached to ribs 16 on each side of deck 10. A corresponding set of frame pulleys 47 are attached to base framework 44 between and below rib pulleys 14. A second cable pair 6 alternately thread deck pulleys 14 and frame pulleys 47 terminating at eyebolts 20. Eyebolts 20 pass through frame members 45, elastomeric cushions 13 and are threaded to adjustment knobs 15. Rotation of adjustment knobs 15 controls tension in second cable pair 6. Second cable pair 6 tension acts upon ribs 16 to stabilize first cable pair 8 with uniform downward loading to produce a parabolic deck shape. Deck pulleys 14 and frame pulleys 47 allow the deck to deform under foot impact. Low tension in second cable pair 6 allows a more soft deck 10 deformation while higher tension produces a stiffer deck 10 feel.

Framework base 44 is configured to be supported by the floor. Upright supports 46 are attached to framework base 44 to provide support for rollers 26,28, curved support surfaces 23 and handles 40,42. Braces 13 stabilize upright supports 46 to framework base 44 and support elastomeric cushions 13. Idlers 34 are adjustably supported by framework base 44 at shafts 29. Rollers 26,28 are rotatably attached to upright supports 46 by shafts 25. First roller 26 is driven by belt 30 engaging pulley 32 and motor 27. Second roller 28 is equipped with brake assembly comprising brake shoe 37 connected to upright supports 46 at pivot 43, spring 35, crossbar 33 and adjustment knobs 31 threaded to brace 45. The generally low load resistance imposed upon second roller 28 maintains belt tension in the belt 12 lower run and compliance of the belt 12 upper run with the curved deck 10. Belt 12 replacement is accomplished by removal of idlers 34 and rollers 26,28. Adjustment brackets 39 and motor adjustment plate 41 are attached to the ends of base framework 44.

Figure 3:
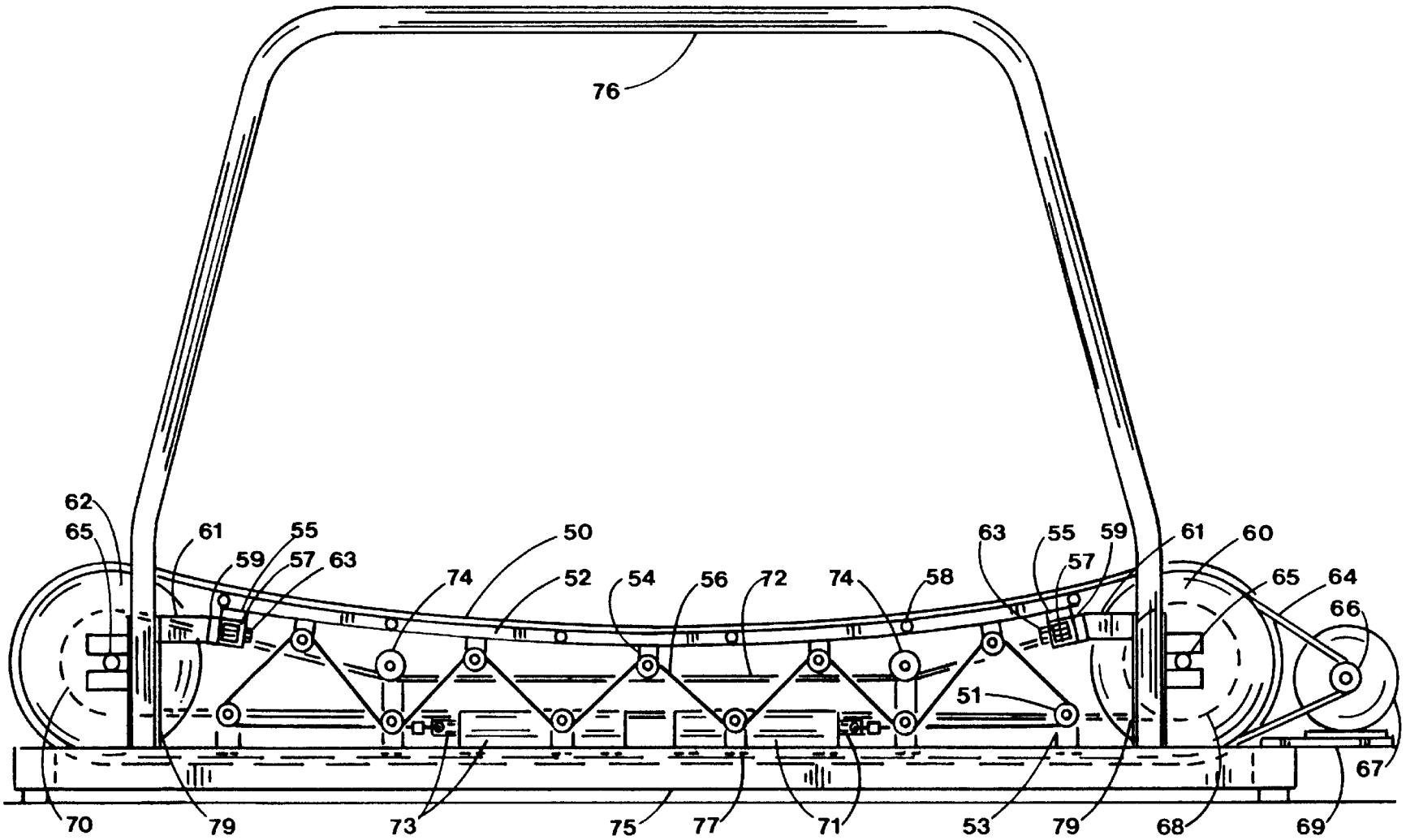
FIG. 3 is a side elevation view of another embodiment of the present invention.

Another embodiment is shown in FIG. 3 where endless belt 50 is trained over first front roller 60 and second rear roller 62. Rollers 60,62 are larger in diameter than rollers 26,28 in the preferred embodiment to avoid the use of idlers 34. Deck segments 52,82 are pivotally interconnected by hinges 58 to form a flexible catwalk to support belt 50 upper run. Deck segments 52,82 have a removable frictionless upper surface. Deck end segments 52,82 are attached to crossbars 57 with elastomeric cushions 55 and crossbars 57 are attached to support 61 with elastomeric cushions 59 and bolt 63. Deck segment 52,82 have semi-rigid ribs 54 attached underneath. Deck pulleys 84 are attached to ribs 54 proximate the center of deck segments 52,82 internal to belt 50 envelope. A corresponding set of frame pulleys 51 are attached to removable crossover supports 77 that connect to base framework 75.

Cable 56 alternately threads deck pulleys 84 and base pulleys 51 terminating at adjustable shock absorbers 71,73 which are supported by removable crossover supports 81. Adjustable shock absorbers 71,73 can be gas or oil filled and spring loaded to maintain cable 56 tension. As the foot impacts belt 50 upper run, the deck segments 52,82 move the cable 56 causing movement in shock absorbers 71,73. Adjustment of shock absorbers 71,73 cause rapid shock attenuation for a stiff deck 52,82 feel or slower attenuation for a softer feel.

Rollers 60,62 are rotatably attached to upright supports 79 by shafts 65. Uprights supports 79 connect to supports 61, handles 76 and are attached to base framework 75. Pulley 68 is attached to first roller 60 while a smaller pulley 70 is attached to second rear pulley 62. Belt 72 engages pulleys 68 and 70 and idlers 74 causing roller 62 to run marginally faster than roller 60 to maintain lower run belt 50 tension. Rollers 60,62 are adjusted for upper run belt 50 compliance to curved deck 52,82. Alternately, a pressure differential (not shown) can be applied to a porous deck to maintain the belt in contact with the curved deck.

Figure 4:
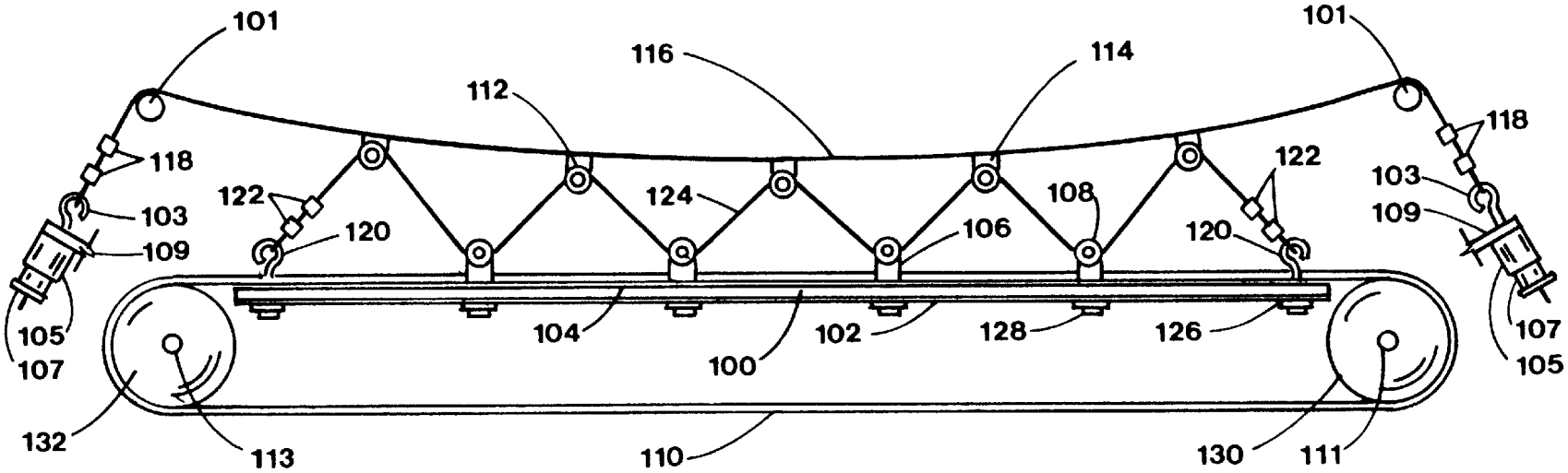
FIG. 4 is a side elevation view of a another embodiment of the present invention.

Another embodiment is depicted in FIG. 4 with belt 110 trained to engage first roller 130 and second roller 132. Rollers 130,132 are rotatably supported by a framework (not shown) at shafts 111,113. Deck 98 supports belt 110 upper run and is composed of generally thin low extensible material 102,104 with elastomeric material 100 sandwiched between to form a deformable semi-rigid deck 98. Deformable crossover supports 126 run side to side under the deck 98. Deck pulleys 108 are attached on each side of belt 110 to brackets 106 which are connected to crossover supports 126 by fasteners 128. Corresponding cable pulleys 112 are attached to a first cable pair 116 by brackets 114. A second cable pair 124 alternately threads cable pulleys 112 and deck pulleys 108 on either side of deck 98 and terminate at eyebolts 120 with cable connectors 122. Eyebolts 120 pass through deck 98 and connect to cross member 126 with fasteners 128.

First cable pair 116 passes over curved supports 101 and terminate at eyebolts 103 with cable connectors 118. Eyebolts 103 pass through brackets 109 and elastomeric cushions 105 and thread to adjustment knob 107. Brackets 109 and curved cable supports 101 are attached to a framework (not shown). Deck 98 is suspended under belt 110 upper run by the first cable pair 116 and second cable pair 124 on either side of deck 98. Deformation from foot impact is absorbed by the elastomeric material 100 internal the deck 98 and by first cable pair elastomeric cushions 105. Cable pulleys 112 and deck pulleys 108 facilitate shock absorption. The deck pulleys 108 and cable pulleys can be made not to rotate providing additional dynamic friction as drag pulleys.

Figure 5:
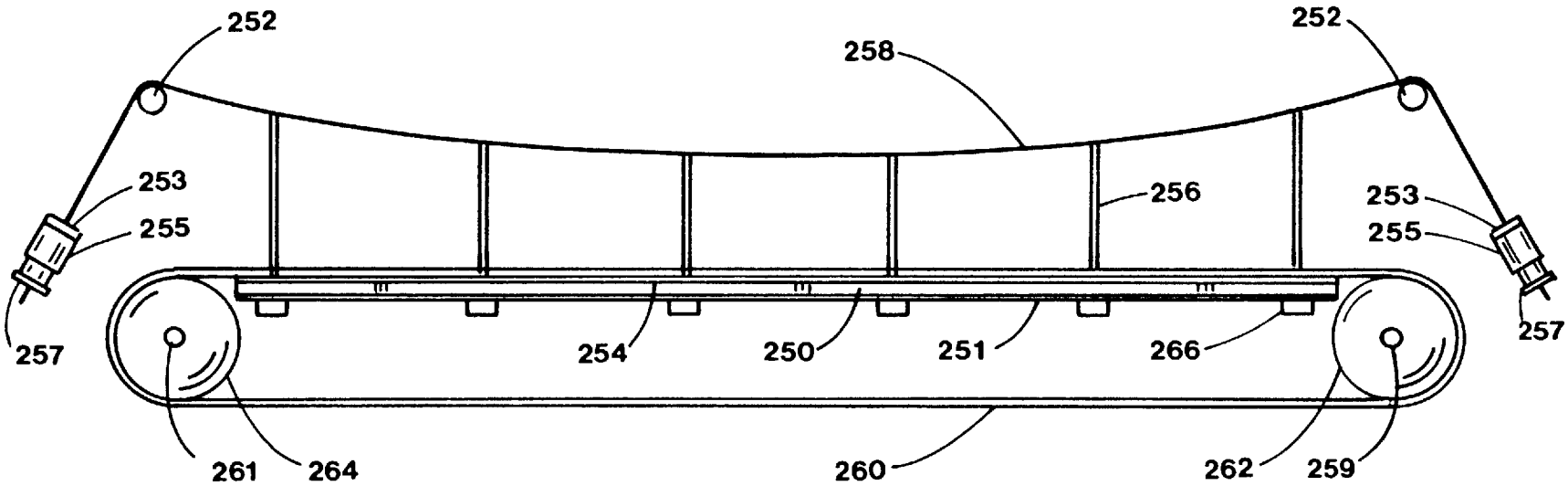
FIG. 5 is a side elevation view of further embodiment of the present invention.

Yet another embodiment is shown in FIG. 5 where the second cable pair 124 of the previous embodiment is replaced with connectors 256. Connectors 256 can be rods, cable, belts, chains or elastomeric strands attached to cable pair 258 and to deck crossovers 266. The cable pair 258 pass over curved supports 252 terminating at elastomeric cushions 255 and adjustment knobs 257. Cushions 255 are supported by brackets 253 which along with curved supports 252 are attached to a framework (not shown). Deck 280 supports upper belt 260 run, and is similar to the previous embodiment having two outer layers 251,254 covering an internal layer 250 or can be of a single material. Belt 260 is trained to engage rollers 262,264 which are rotatably attached at shafts 259,261 to the framework (not shown). Foot impact is absorbed by deck 280, elastomeric cushions 255 and elastomeric strands 256, where used.

Figure 6:
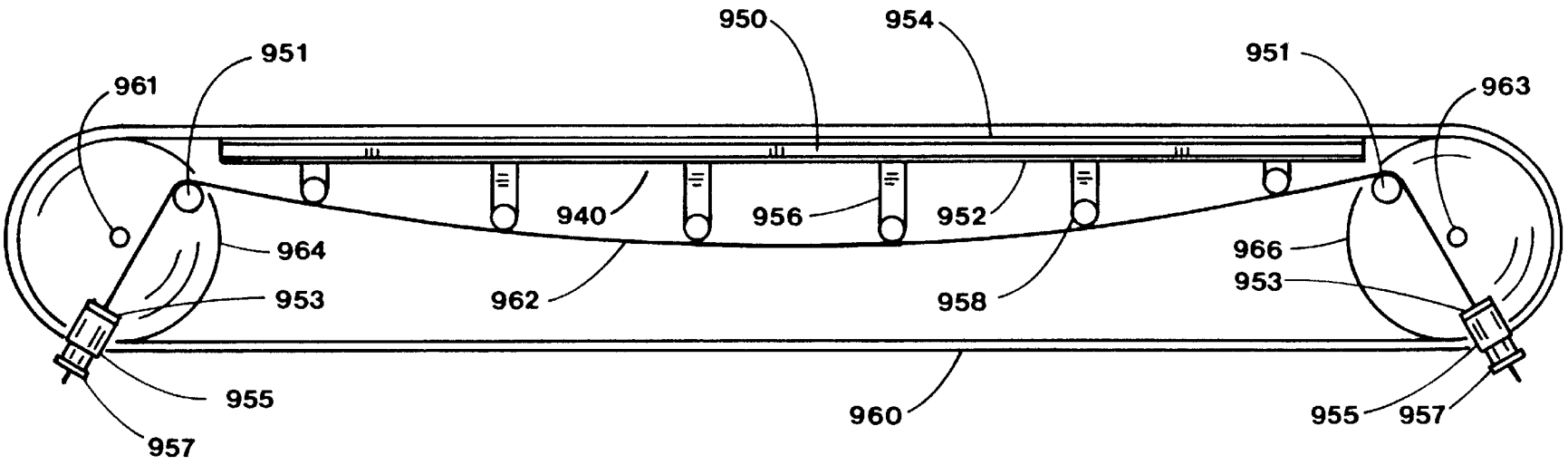
FIG. 6 is a side elevation view of a further embodiment of the present invention.

Another embodiment is shown in FIG. 6 where the deck 940 is generally linear or crowned to support belt 960. The deck 940 can be solid material or a composite with upper layer 954, core layer 950 and under layer 952. Intermediate crossover members 956 vary in height to support deck 952 and can contain elastomeric material. Curved deck supports 958 are attached to crossover members 956 and contact a cable pair 962. Cable pair 962 suspends the deck 940 passing over curved supports 951 terminating at adjustment knob 957. Cushions 955 are located between adjustment knobs 957 and brackets 953. Brackets 953 and curved supports 951 are attached to a framework (not shown).

Belt 960 is trained to engage rollers 964 and 966 which are rotatably attached to a framework by shafts 961 and 963. A suitable motor or load resistance can be engaged to either roller 964,966. Foot impact deforms deck 940 causing curved deck supports 958 to move relative to cables 962. The normal parabolic cable curve changes to distribute foot impact over the suspension system. Foot impact shock is absorbed by cushions 955 and other cushion materials used such as deck core 954 and cushion material in crossover members 956.

Figure 7:
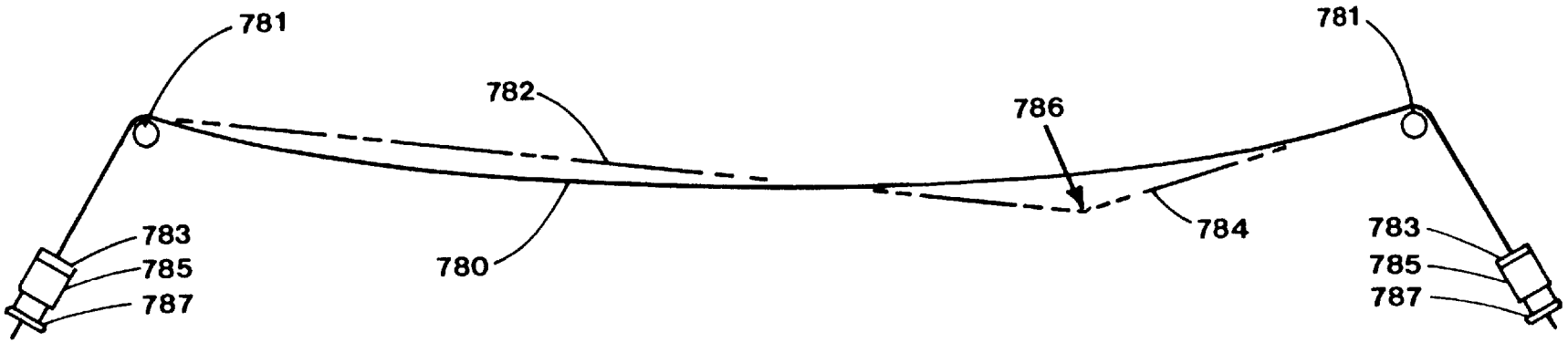
FIG. 7 is a side elevation schematic of a parabolic cable under discrete load.

FIG. 7 shows parabolic cable 780 passing over curved supports 781 terminating at elastomeric cushions 785 and adjustment knobs 787. Brackets 783 and curved supports 781 are attached to a framework (not shown). Load 786 deforms cable 780 into two generally linear cable segments 782 and 784. The portion of cable 780 that receives the load moves in the downward and longitudinal directions towards shorter cable segment 784 as shown by load arrow 786. Deformation in both vertical and horizontal directions provides better foot impact cushion and superior shock absorption because the foot impact is converted into a shock wave moving rapidly away from the foot to be absorbed by cable elastomeric cushions, deck elastomeric material and shock absorber systems. The shock is not returned directly to the foot, therefore, injuries such as stone bruise and shin splints are avoided, even after long periods of operator use.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise treadmill comprising;

a framework means, said framework means being configured to be supported by the floor;

a belt means, said belt means rotatably engaged with a first and a second roller means, said first and second roller means rotatably attached to said framework means proximate each end;

a deck means, said deck means positioned between said first and second roller means and operably associated with said belt means;

a flexible linking means, said flexible linking means configured as a predetermined non-linear curve to suspend said deck means;

means for flexible linking attachment, said means for flexible linking attachment positioned proximate each end of said flexible linking means for non-rigid connection to said framework means;

said deck means operably associated with said flexible linking means whereby said flexible linking means allows said deck means to deform under foot impact of the user.

2. The exercise treadmill according to claim 1 wherein said means for flexible linking attachment further comprises a cushion means operably associated with said flexible linking means and said framework means to absorb foot impact shock.

3. The exercise treadmill according to claim 2 wherein said cushion means further comprises an adjustment means to vary foot impact shock absorption.

4. The exercise treadmill according to claim 1 further comprising a coupling means, said coupling means operably associated with said flexible linking means intermediate said deck ends means whereby said coupling means controls deck deformation.

5. The exercise treadmill according to claim 4 wherein said coupling means comprises a second flexible linking means, said second flexible linking means alternately threading a set of deck pulleys and a set of frame pulleys;

said deck pulleys attached to said deck means intermediate said deck ends and said frame pulleys attached to said framework means;

said second flexible linking means terminating with adjustable cushion means whereby said adjustable cushion means absorbs foot impact shock.

6. The exercise treadmill according to claim 4 wherein said coupling means further includes elastomeric means, said elastomeric means operably associated with said flexible linking means and said deck means to absorb foot shock.

7. The exercise treadmill according to claim 1 wherein said flexible linking means comprises a pair of cable means, said cable means disposed on either side of said deck means wherein said cable means provides suspension support for said deck means.

8. The exercise treadmill according to claim 7 wherein said cable means is supported by curved surface means proximate said deck ends whereby the direction of said cable means is changed.

9. The exercise treadmill according to claim 1 wherein said deck means further comprises a removable frictionless material in contact with the underside of said belt upper run whereby deck drag imposed upon the belt under foot load is reduced.

10. The exercise treadmill according to claim 5 wherein said adjustable cushion means further comprises a piston means having pressure differential across said piston means, to control the tension of said second flexible linking means.

11. The exercise treadmill according to claim 1 further comprising an adjustment means whereby one end of said framework means can be raised higher than the other end to incline said deck means.

12. The exercise treadmill according to claim 1 further comprising a motor means engaged with one of said roller means to regulate the speed of said belt means.

13. The exercise treadmill according to claim 1 wherein said deck means is a deck composite means comprised of multiple layers with at least one layer composed of an elastomeric material whereby said composite deck means absorbs foot impact shock.

14. The cushion means according to claim 2 wherein said cushion means is non-linear whereby shock is attenuated at a non-proportional rate of deformation.

15. The cushion means according to claim 5 wherein said cushion means is non-linear whereby shock is attenuated at a non-proportional rate of deformation.

16. An exercise treadmill comprising;

a framework means, said framework means being configured to be supported by the floor;

a first roller means and a second roller means, said first and second roller means having an axis of rotation substantially horizontal and parallel to each other, said first and second roller means being rotatably attached to said framework means proximate each end, a belt means, said belt means rotatably engaged with said first and said second roller means, a deck means, said deck means positioned between said first and second roller means and operably associated with said belt means;

a flexible deck suspension means composed of a plurality of deck segment means interconnected by flexible connection means, said flexible deck suspension means positioned between said first and second roller means, said flexible deck suspension means having a non-rigid attachment at each end to said framework means;

said flexible deck suspension means operably associated with said deck means whereby said deck segment means experience relative movement with foot impact.

17. The exercise treadmill according to claim 16 further comprising a cushion means, said cushion means positioned proximate said flexible deck suspension means end operably associated with said framework means whereby said cushion means absorbs the shock of foot impact.

18. The exercise treadmill according to claim 16 further comprising a coupling means, said coupling means operably associated with said deck segment means intermediate said deck ends whereby said coupling means controls deck deformation.

19. The exercise treadmill according to claim 18 wherein said coupling means comprises a flexible linking means, said flexible linking means alternately threading a set of deck pulleys and a set of frame pulleys;

said deck pulleys attached to said deck segment means intermediate said deck ends and said frame pulleys attached to said framework means;

said flexible linking means terminating with adjustable cushion means whereby said adjustable cushion means absorbs foot impact shock.

20. The exercise treadmill according to claim 18 wherein said coupling means further includes elastomeric means, said elastomeric means operably associated with said flexible deck means to absorb foot shock.

21. The exercise treadmill according to claim 16 wherein said deck segment means further comprises removable frictionless surfaces in contact with the underside of the upper run of said belt means whereby belt drag is reduced under foot load.

22. An exercise treadmill comprising;

a framework means, said framework means being configured to be supported by the floor;

a first roller means and a second roller means, said first and second roller means having an axis of rotation substantially horizontal and parallel to each other, said first and second roller means being rotatably attached to said framework means proximate each end, a belt means, said belt means rotatably engaged with said first and said second roller means, a deck means, said deck means disposed between said first and second roller means;

a flexible linking means, said flexible linking means configured as a predetermined non-linear curve to suspend said deck means;

means for flexible linking attachment, said means for flexible linking attachment positioned proximate each end of said flexible linking means for non-rigid connection to said framework means;

said belt means operably associated with said deck means whereby a portion of said belt means moves over said deck means along a predetermined curve.

23. The exercise treadmill according to claim 22 wherein said predetermined curve is a parabolic curve configured to enhance impact absorption from the foot of the user.

24. The exercise treadmill according to claim 22 further comprising an adjustment means whereby said flexible linking means may be changed to regulate the curvature of said deck means.

25. The exercise treadmill according to claim 22 further comprising an adjustment means whereby a predetermined distance between said first roller means and said second roller means can be changed to regulate the curvature of a portion of said belt means.

26. The exercise treadmill according to claim 22 wherein said deck means further having a porosity means whereby a fluid means can pass through said deck means.

27. The exercise treadmill means according to claim 26 further comprising a pressure differential means applied to the underside of said deck means whereby at least a portion of said belt means is held in contact with said deck means.

28. The exercise treadmill according to claim 22 further comprising a belt idler means whereby said belt idler means can be adjusted to regulate the curvature of a portion of said belt means.

29. The exercise treadmill according to claim 22 further comprising a rotary coupling means to engage said first and second roller means whereby one of said roller means rotates slower than the other said roller means causing a portion of said belt means to have higher tension.

* * * * *